US008573955B2

(12) United States Patent
Kim et al.

(10) Patent No.: US 8,573,955 B2
(45) Date of Patent: Nov. 5, 2013

(54) SCROLL COMPRESSOR WITH NOISE REDUCING DISCHARGE OPENING

(75) Inventors: Jeonghun Kim, Gimhae-si (KR); Suchul Kim, Masan-si (KR); Ki-won Park, Gimhae-si (KR)

(73) Assignee: LG Electronics Inc., Seoul (KR)

( * ) Notice: Subject to any disclaimer, the term of this patent is extended or adjusted under 35 U.S.C. 154(b) by 450 days.

(21) Appl. No.: 12/867,575

(22) PCT Filed: Mar. 17, 2009

(86) PCT No.: PCT/KR2009/001346
§ 371 (c)(1),
(2), (4) Date: Oct. 13, 2010

(87) PCT Pub. No.: WO2009/116791
PCT Pub. Date: Sep. 24, 2009

(65) Prior Publication Data

US 2011/0033327 A1 Feb. 10, 2011

(30) Foreign Application Priority Data

Mar. 20, 2008 (KR) ..... 10-2008-0026012

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl.
USPC ..... 418/55.2; 418/55.1

(58) Field of Classification Search
USPC ..... 418/55.2, 55.1
See application file for complete search history.

(56) References Cited

U.S. PATENT DOCUMENTS

| | | | | |
|---|---|---|---|---|
| 5,249,941 | A * | 10/1993 | Shibamoto | 418/55.5 |
| 5,257,920 | A * | 11/1993 | Takeda | 418/55.2 |
| 5,447,418 | A | 9/1995 | Takeda et al. | |
| 5,494,422 | A | 2/1996 | Ukai et al. | |
| 5,573,389 | A * | 11/1996 | Fukuhara et al. | 418/55.5 |
| 5,863,191 | A * | 1/1999 | Motegi et al. | 418/55.1 |
| 6,322,340 | B1 * | 11/2001 | Itoh et al. | 418/55.2 |
| 2007/0178002 | A1 * | 8/2007 | Hiwata et al. | 418/55.2 |

FOREIGN PATENT DOCUMENTS

| | | |
|---|---|---|
| CN | 1103932 | 6/1995 |

OTHER PUBLICATIONS

Chinese Office Action dated Aug. 27, 2012. (with translation).
International Search Report issued in PCT/KR2009/001346 dated Nov. 6, 2009.

* cited by examiner

*Primary Examiner* — Mary A Davis
(74) *Attorney, Agent, or Firm* — KED & Associates LLP

(57) ABSTRACT

A scroll compressor is provided that includes a hermetic container into and out of which a refrigerant flows, a driving device installed in the hermetic container to rotate a rotation axis, an orbiting scroll fixed to the rotation axis and rotated with the rotation axis, and a fixed scroll fixed to the hermetic container and engaged with the orbiting scroll to define a compression chamber, in which the refrigerant is compressed, by an interaction with the orbiting scroll. A discharge hole of the fixed scroll comprises a discharge inlet portion through which high pressure refrigerant flows in, a discharge outlet portion through which the high pressure refrigerant flows out, the discharge outlet portion being eccentric to the discharge inlet portion, and a bottleneck section through which the discharge inlet portion and the discharge outlet portion communicate with each other. The scroll compressor reduces pulsation noise of the refrigerant to improve noise performance.

3 Claims, 3 Drawing Sheets

SCROLL COMPRESSOR WITH NOISE REDUCING DISCHARGE OPENING

TECHNICAL FIELD

The present invention relates to a scroll compressor, wherein refrigerant is compressed to a high pressure in a compression chamber between a fixed scroll and an orbiting scroll, and more particularly, to a scroll compressor capable of reducing pulsation noise, when discharging high pressure refrigerant.

BACKGROUND ART

In general, a compressor is a mechanical apparatus compressing gas by means of a rotating motion of an impeller or rotor or a reciprocating motion of a piston. Such compressors are divided into a reciprocating compressor, a rotary compressor and a vane type compressor according to compressing methods.

Normally, in a scroll compressor which is a kind of rotary compressor, a fixed scroll and an orbiting scroll are installed at upper and lower portions inside a hermetic container. The fixed scroll is fixed to the hermetic container, and the orbiting scroll is installed to be eccentrically rotatable with respect to the fixed scroll by a driving unit. Here, involute laps formed respectively on the fixed scroll and the orbiting scroll are engaged with each other to define a compression chamber compressing refrigerant. Since a space between the hermetic container and the orbiting scroll is filled with refrigerant to be sucked into the compression chamber, it maintains a low pressure state. On the contrary, since a space between the hermetic container and the fixed scroll is filled with refrigerant compressed in the compression chamber, it maintains a high pressure state.

FIG. 1 is a view illustrating an example of a fixed scroll of a conventional scroll compressor. As illustrated in FIG. 1, in the conventional fixed scroll 1, involute laps 1*a* defining a compression chamber P are formed at a lower portion of a disk, and a discharge hole 1*b* bored like a straight line is provided in a central blocked portion of the disk. Accordingly, when an orbiting scroll (not shown) is eccentrically rotated with respect to the fixed scroll 1, refrigerant is sucked into the compression chamber P between the fixed scroll 1 and the orbiting scroll, compressed, and discharged through the discharge hole 1*b* of the fixed scroll 1.

The conventional scroll compressor has a disadvantage in that, since the discharge hole of the fixed scroll is formed like a straight line, pulsation noise of refrigerant excessively occurs. Even if a separate muffler is added to suppress the pulsation noise of refrigerant, component addition and mounting processing complicates a production process and increases a production cost.

DISCLOSURE

Technical Problem

The present invention is conceived to solve the aforementioned problems in the prior art. An object of the present invention is to provide a scroll compressor, wherein high temperature high pressure refrigerant passes through a discharge hole of a fixed scroll, reducing pulsation noise.

Technical Solution

A scroll compressor according to the present invention for achieving the above object includes: a hermetic container, refrigerant flowing in and out of which; a driving unit installed in the hermetic container to rotate a rotation axis; an orbiting scroll fixed to the rotation axis and rotated with the rotation axis; and a fixed scroll fixed to the hermetic container, engaged with the orbiting scroll to define a compression chamber, and compressing refrigerant by an interaction with the orbiting scroll, a discharge direction of a discharge space-side discharge hole heading from the compression chamber to the discharge space not corresponding to a discharge direction of a compression chamber-side discharge hole.

In addition, according to the present invention, the discharge hole of the fixed scroll is formed like two or more stairs.

Moreover, according to the present invention, the discharge hole of the fixed scroll includes a discharge inlet portion through which high pressure refrigerant flows in, a discharge outlet portion through which high pressure refrigerant flows out, the discharge outlet portion being eccentric to the discharge inlet portion, and a discharge connection portion making the discharge inlet portion and the discharge outlet portion communicate with each other.

Further, according to the present invention, the discharge inlet portion and the discharge outlet portion are formed vertically in an eccentric state, and the discharge connection portion is formed horizontally.

Furthermore, according to the present invention, the discharge inlet portion and the discharge outlet portion include a bottleneck section where certain areas communicate with each other, and the discharge connection portion is omittable.

Still furthermore, according to the present invention, a sectional area D2 of the discharge outlet portion is larger than a sectional area D1 of the discharge inlet portion.

Still furthermore, according to the present invention, a flow direction length L2 of the discharge outlet portion is larger than a flow direction length L1 of the discharge inlet portion.

Still furthermore, according to the present invention, a sectional area D3 of the bottleneck section is 0.5 to 0.8 times of the sectional area D2 of the discharge outlet portion.

Still furthermore, according to the present invention, the flow direction length L2 of the discharge outlet portion is larger than the flow direction length L1 of the discharge inlet portion by over 1.2 times.

Advantageous Effects

In the scroll compressor with the above construction according to the present invention, since the discharge hole of the fixed scroll is formed like stairs, when high temperature high pressure refrigerant passes through the discharge hole of the fixed scroll, pulsation noise decreases. It is thus possible to efficiently suppress noise without using a muffler, and also possible to simplify a production process and cut down a cost by omitting the muffler.

MODE FOR INVENTION

Hereinafter, preferred embodiments of the present invention will be described in detail with reference to the accompanying drawings.

Figure 1:
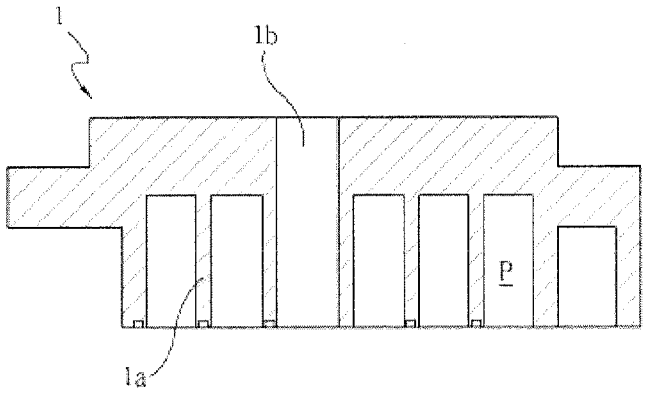
FIG. 1 is a view illustrating an example of a fixed scroll of a conventional scroll compressor.
Figure 2:
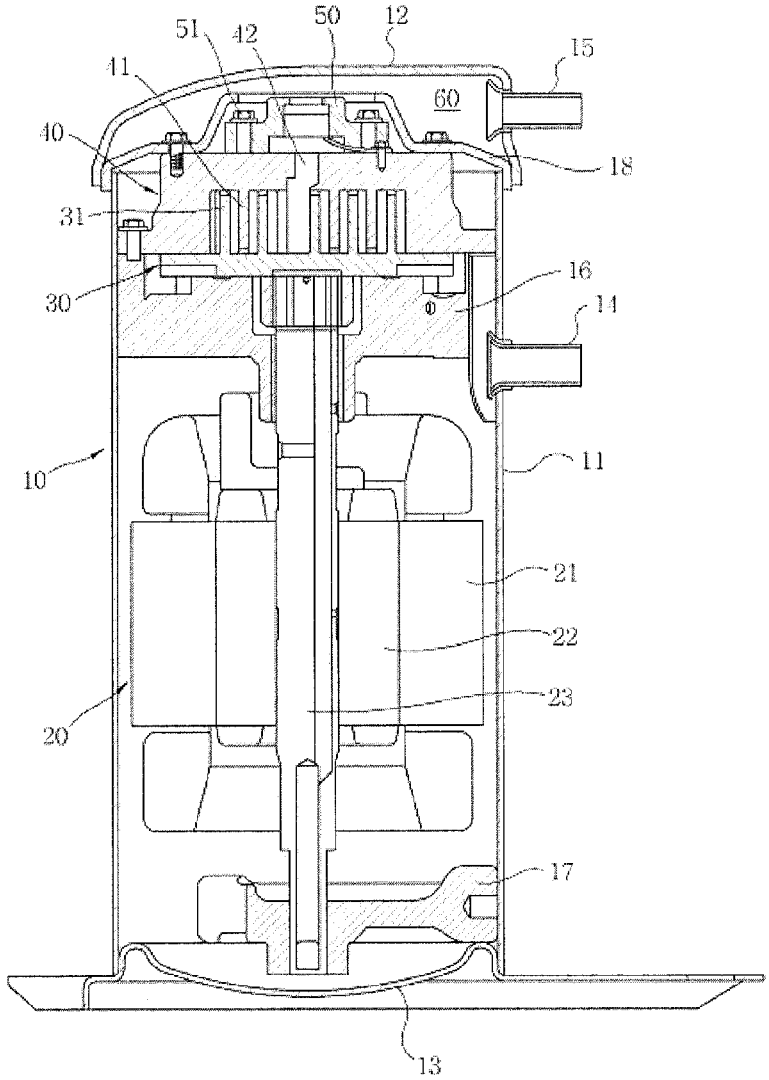
FIG. 2 is a view illustrating an embodiment of a scroll compressor according to the present invention.

FIG. 2 is a view illustrating an embodiment of a scroll compressor according to the present invention.

As illustrated in FIG. 2, the embodiment of the scroll compressor according to the present invention includes a hermetic container 10, refrigerant flowing in and out of which, a driving unit 20 installed in the hermetic container 10 to supply a rotation force, an orbiting scroll 30 installed to be rotatable by the driving unit 20, a fixed scroll 40 fixed to the inside of the hermetic container 10, and engaged with the orbiting scroll 30 to define a compression chamber P compressing refrigerant, and a control unit (not shown) for controlling an operation of the driving unit 20.

The hermetic container 10 is comprised of a main shell 11 formed like a cylinder, upper and lower shells 12 and 13 coupled respectively to upper and lower ends of the main shell 11 to define a hermetic space, a suction pipe 14 installed on one side of the main shell 11 so that refrigerant can flow in therethrough, a discharge pipe 15 installed on one side of the upper shell 12 so that high temperature high pressure refrigerant can flow out therethrough, a main frame 16 and a sub frame 17 fixed to upper and lower portions in the main shell 11 to mount the driving unit 20, the orbiting scroll 30 and the fixed scroll 40 thereon, and an upper diaphragm 18 installed between the main shell 11 and the upper shell 12 so as to define a discharge space of collecting high pressure refrigerant discharged from the fixed scroll 40 before being discharged to the discharge pipe 15.

The driving unit 20 is a kind of motor composed of a stator 21, a rotor 22 installed in the stator 21 and rotated with the stator 21 by a mutual electromagnetic force, and a rotation axis 23 rotated, engaged with the center of the rotor 22. Here, an upper end of the rotation axis 23 is rotatably installed, penetrating through the main frame 16, to be eccentrically fixed to the orbiting scroll 30, and a lower end of the rotation axis 23 is fitted into the sub frame 17 and rotatably installed.

Spirally-protruding laps 31 are provided on a top surface of the orbiting scroll 30. The rotation axis 23 is press-fit into an eccentric position of a bottom surface of the orbiting scroll 30, and the bottom surface of the orbiting scroll 30 is put on the main frame 16.

As in the orbiting scroll 30, spirally-protruding laps 41 are provided on a bottom surface of the fixed scroll 40, and a discharge hole 42 communicating with the compression space P is provided in a center of a top surface of the fixed scroll 40. The fixed scroll 40 is put on the orbiting scroll 30 so that the laps 41 of the fixed scroll 40 can be engaged with the laps 31 of the orbiting scroll 30, and then the circumference of the fixed scroll 40 is bolt-fixed to the main frame 16.

A muffler apparatus 50 is positioned on the fixed scroll 40, and installed on a passage of the refrigerant discharge hole 42. The muffler apparatus 50 can be integrally manufactured with the fixed scroll 40, or coupled thereto by screws 51. Such a muffler apparatus 50 serves to suppress total noise of the compressor.

A discharge space 60 communicates with the discharge hole 42. Refrigerant compressed in the compression space P is discharged to the discharge space 60 through the discharge hole 42. That is, refrigerant compressed to a high pressure is temporarily stored in the discharge space 60 before flowing out of the compressor through the discharge pipe 15.

Figure 3:
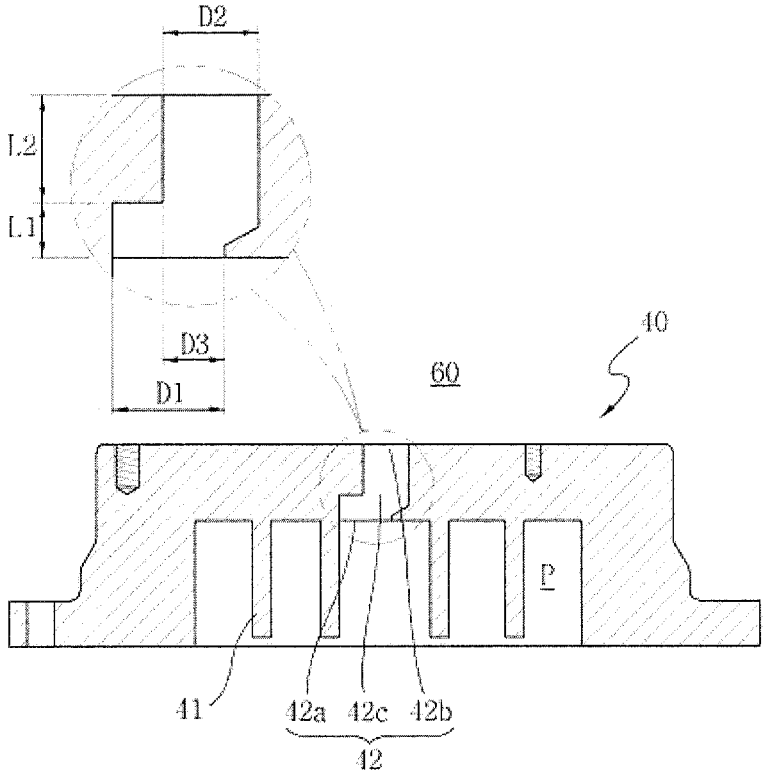
FIG. 3 is a view illustrating an embodiment of a discharge hole of a fixed scroll of the scroll compressor according to the present invention.

FIG. 3 is a view illustrating an embodiment of the discharge hole of the fixed scroll of the scroll compressor according to the present invention.

A fixed scroll 40 is fixed to a hermetic container, is engaged with an orbiting scroll 30 to define a compression chamber, and compresses refrigerant by an interaction with the orbiting scroll 30. A discharge hole 42 communicating with a compression space P and a discharge space 60 is formed in the fixed scroll 40. A discharge direction of the discharge space-side discharge hole 42 heading from the compression chamber to the discharge space 60 does not correspond to a discharge direction of the compression chamber-side discharge hole 42.

The embodiment of the discharge hole 42 of the fixed scroll 40 will be described in detail with reference to FIG. 3. Since the discharge hole 42 is formed like stepped stairs to function as a muffler, when high pressure refrigerant passes through the discharge hole 42, noise or impact sound decreases.

In more detail, the discharge hole 42 includes a discharge inlet portion 42*a* communicating with the compression space P so that high pressure refrigerant can flow in therethrough, a discharge outlet portion 42*b* being eccentric to the discharge inlet portion 42*a* and communicating with the discharge space 60 so that high pressure refrigerant can flow out therethrough, and a discharge connection portion 42*c* making the discharge inlet portion 42*a* and the discharge outlet portion 42*b* communicate with each other. The discharge inlet portion 42*a* and the discharge outlet portion 42*b* are formed vertically in an eccentric state, and the discharge connection portion 42*c* is formed horizontally.

Here, when an eccentric distance of the discharge inlet and outlet portions 42*a* and 42*b* is larger than a radius sum (D1/2+D2/2) of the discharge inlet and outlet portions 42*a* and 42*b*, the discharge connection portion 42*c* horizontally exists. However, when the eccentric distance of the discharge inlet and outlet portions 42*a* and 42*b* is smaller than the radius sum (D1/2+D2/2) of the discharge inlet and outlet portions 42*a* and 42*b*, even if the discharge connection portion 42*c* is not horizontally formed, it exists as a bottleneck section where certain areas of the discharge inlet and outlet portions 42*a* and 42*b* communicate with each other. Since the vertical discharge inlet and outlet portions 42*a* and 42*b* are exposed to upper and lower surfaces of the fixed scroll 40, they can be easily formed by a milling work such as an end mill. Meanwhile, since the horizontal discharge connection portion 42*c* is formed in the fixed scroll 40, it is difficult to manufacture. Therefore, preferably, the discharge connection portion 42*c* is formed as the bottleneck section combining the discharge inlet and outlet portions 42*a* and 42*b*.

In addition, since a pressure waveform is very high in the discharge outlet portion 42*b* due to the discharge of refrigerant compressed in the compression space P, in order for the discharge hole 42 to function as a damper reducing the pulsation of refrigerant, preferably, a sectional area D2 of the discharge outlet portion 42*b* is set larger than a sectional area D1 of the discharge inlet portion 42*a*, and a length L2 of the discharge outlet portion 42*b* is set larger than a length L1 of the discharge inlet portion 42*a*. For example, the length L2 of the discharge outlet portion 42*b* is set larger than the length L1 of the discharge inlet portion 42*a* by over 1.2 times, to thereby improve a noise suppression effect. Moreover, in a case where the discharge connection portion 42*c* is formed as the bottleneck section (hereinafter, referred to as 42*c*), the smaller a sectional area D3 of the bottleneck section 42*c* is, the higher a passage resistance of flow is, and the larger the sectional area D3 of the bottleneck section 42*c* is, the worse a pulsation noise suppression effect is. Accordingly, preferably, the sectional area D3 of the bottleneck section 42*c* is set to have a certain ratio size of the sectional area D1 of the discharge inlet portion 42*a* or the sectional area D2 of the discharge outlet portion 42*b*. For example, the sectional area D3 of the bottleneck section 42*c* is set to be 0.5 to 0.8 times of the sectional area D2 of the discharge outlet portion 42*b*, to thereby improve a noise suppression effect.

Figure 4:
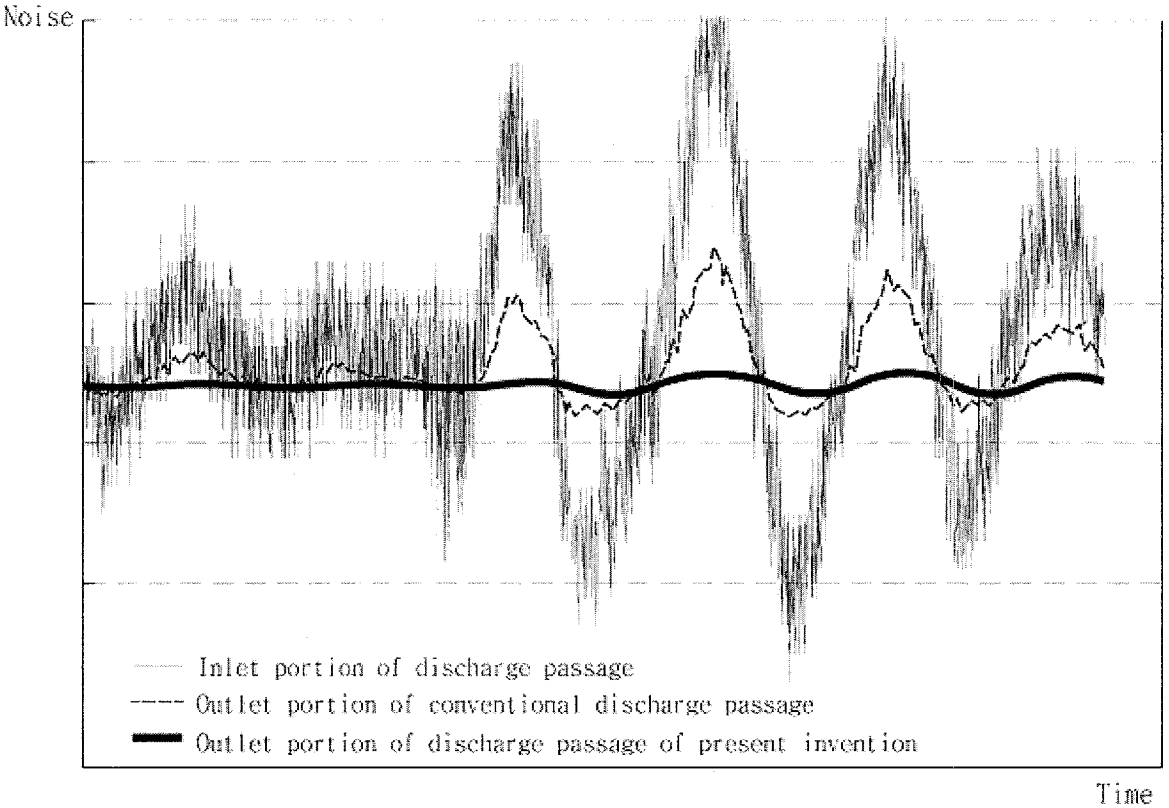
FIG. 4 is a graph showing pulsation noise by positions in a discharge hole of the conventional fixed scroll and the discharge hole of the fixed scroll of the present invention.

FIG. 4 is a graph showing pulsation noise by positions in a discharge hole of a conventional fixed scroll and a discharge hole of a fixed scroll of the present invention. While the discharge hole of the conventional fixed scroll is formed like a straight line, the discharge hole of the fixed scroll of the present invention is formed like one stair with a step difference. Referring to FIG. 4, pulsation noise of refrigerant is considerably generated both in a conventional discharge passage inlet portion and a discharge passage inlet portion of the present invention, but reduced in a conventional discharge passage outlet portion and a discharge passage outlet portion of the present invention. Particularly, since the discharge passage of the present invention is constructed to have a higher passage resistance than that of the conventional discharge passage and to cause pressure variations, noise is much more reduced in the discharge passage outlet portion of the present invention than in the conventional discharge passage outlet portion.

The present invention has been described in detail with reference to the embodiments and the attached drawings. However, the scope of the present invention is not limited to the embodiments and the drawings, but defined by the appended claims.

The invention claimed is:

1. A scroll compressor, comprising:

a hermetic container configured to receive a refrigerant flowing into and out thereof;

a driving device installed in the hermetic container that rotates a rotation axis;

an orbiting scroll fixed to the rotation axis and rotated with the rotation axis; and a fixed scroll fixed to the hermetic container and engaged with the orbiting scroll to define a compression chamber, to compress the refrigerant by an interaction with the orbiting scroll, wherein a discharge hole of the fixed scroll comprises a discharge inlet portion through which high pressure refrigerant flows in, a discharge outlet portion through which the high pressure refrigerant flows out, the discharge outlet portion being eccentric to the discharge inlet portion, and a bottleneck section through which the discharge inlet portion and the discharge outlet portion communicate with each other, wherein a sectional area of the discharge outlet portion is larger than a sectional area of the discharge inlet portion, wherein a flow direction length of the discharge outlet portion is larger than a flow direction length of the discharge inlet portion, and wherein a sectional area of the bottleneck section is 0.5 to 0.8 times of the sectional area of the discharge outlet portion to thereby improve a noise suppression effect.

2. The scroll compressor of claim 1, wherein the discharge hole of the fixed scroll comprises two or more stairs.

3. The scroll compressor of claim 1, wherein the flow direction length of the discharge outlet portion is larger than the flow direction length of the discharge inlet portion by greater than 1.2 times.

* * * * *